United States Patent [19]

Tomlinson

[11] Patent Number: 4,870,793

[45] Date of Patent: Oct. 3, 1989

[54] SUPPORT BASE SYSTEM FOR ARCHITECTURAL PANELS

[75] Inventor: Martin G. Tomlinson, Middletown, Ohio

[73] Assignee: Mound Steel Corporation, Springboro, Ohio

[21] Appl. No.: 134,102

[22] Filed: Dec. 15, 1987

[51] Int. Cl.[4] ..... F04H 1/00

[52] U.S. Cl. ..... 52/241; 52/126.1; 52/126.3

[58] Field of Search ..... 52/241, 126.3, 126.4, 52/126.1, 238.1, 239; 49/501; 160/90, 371; 198/335, 336, 337, 338

[56] References Cited

U.S. PATENT DOCUMENTS

| | | | |
|---|---|---|---|
| 2,374,057 | 4/1945 | Watkins | 154/2.71 |
| 3,393,484 | 7/1968 | Dunnington | 52/287 |
| 3,593,475 | 7/1971 | Lague | 52/241 |
| 3,983,670 | 10/1976 | Lightfoot | 52/241 |
| 3,989,133 | 11/1976 | Courson et al. | 198/335 |
| 3,991,877 | 11/1976 | Kraft et al. | 198/335 |
| 3,996,712 | 12/1976 | Howell | 52/241 |
| 4,240,235 | 12/1980 | Nawa | 52/731 |
| 4,596,100 | 6/1986 | Grocott | 52/241 |
| 4,612,743 | 9/1986 | Salzer | 49/501 |
| 4,646,907 | 3/1987 | Streibig et al. | 198/335 |

FOREIGN PATENT DOCUMENTS

| | | | |
|---|---|---|---|
| 272187 | 11/1965 | Australia | 52/241 |
| 2819617 | 11/1979 | Fed. Rep. of Germany | 49/501 |

*Primary Examiner*—Michael Safavi

*Attorney, Agent, or Firm*—Charles R. Wilson

[57] ABSTRACT

A support base system is provided for holding architectural panels in adjustable height positions. The support base system comprises an elongated U-shaped support base with a channel extending from its top surface. A U-shaped insert is positioned in a bottom portion of the channel. Locking angles are positioned along the top surface of the support base with one leg having a series of ribs extending into the channel. A series of set screw holes along at least one side of the support base with set screws therein for communication with the locking angles are used to adjustably abut the locking angles to the panel. The panel is positioned in the channel a desired depth and the set screws tightened to securely hold the panel.

8 Claims, 3 Drawing Sheets

SUPPORT BASE SYSTEM FOR ARCHITECTURAL PANELS

Invention relates to a support base system. More particularly, the invention relates to a support base system for holding one or more architectural panels in an adjustable height position.

BACKGROUND OF THE INVENTION

Architectural panels of various types are found extensively in commercial and public buildings. Such panels are used for dividing large open spaces into smaller semi-private rooms, creating hallways or corridors, providing a guard for steps and walkways, and generally for creating restricted areas or passageways. The architectural panels are usually one-half inch in thickness and about three to four feet in height. They can have a length of a few feet as when used to create a station area or several feet as when used to form a corridor.

A common problem with any architectural panel which does not extend from wall to wall or from floor to ceiling is how to hold the panel in a fixed position. An installed panel will necessarily be subjected to substantial forces due to normal use and accidental bumpings. Any mounting means system used for holding the panels must be sturdy enough to make the panels substantially immovable in response to lateral forces incurred during use. The means must be such that, it, per se, is not expensive and there is no substantial labor cost involved with its utilization. At the same time, any mounting means which is open to view must have a pleasing appearance.

Certain architectural panels can be bolted directly to the floor with the use of right angle braces. Most known panels, though, have been installed with a support base system. A support base with panel receiving means such as a channel is bolted to the floor. Next, a panel is positioned in the channel of the base and secured thereto by the use of means such as an expanding grout material. Additional panels can be installed adjoining the first panel to create virtually any length structure desired. These systems do securely hold the panels in a fixed position. However, there is a substantial amount of time involved in adding the grout material and cleaning up any excess. Additionally, the expanding grout material can not be used in support bases which are installed on a sloping surface due to the material's slow set-up time and tendency to flow.

Known support base systems are not able to hold the panels in adjustable height positions. That is, the panels are installed in the base system without any height adjustment possible to account for an uneven floor surface or a desired design feature. Any unevenness in the floor surface in effect is transferred to the architectural panel's top edge and can be very noticeable.

Another drawback associated with known support base systems for architectural panels is encountered when an individual panel is damaged and must be replaced. A substantial amount of labor must be expended to remove the panel from its base. Adjoining panels in the same base system may also be damaged in the process.

There has now been developed a support base system for architectural panels which is useful for readily installing the panels. The support base system is capable of holding the panels in adjustable height positions which are securely fixed, yet can readily be removed or further adjusted if desired.

SUMMARY OF THE INVENTION

A support base system for architectural panels is capable of securely holding the panels in adjustable height positions. The system comprises (a) an elongated U-shaped support base with a channel extending from its top surface to accommodate a panel, (b) a U-shaped insert positioned in a bottom portion of the channel, said insert having an inside cross dimension of sufficient width to receive and hold the panel in a laterally substantially immovable position, (c) a pair of locking angles positioned on a top surface of the support base, each of said locking angles extending the length of the support base with a first leg lying substantially flat with the top surface of the support base and a second leg extending into the channel, further wherein a face of said second leg has gripping ribs to engage a side of the panel, (d) a polymeric film optionally positioned between each locking angle's set of ribs and panel face to better hold said panel in position, and (e) a series of set screw holes along at least one side of the support base with set screws therein for communication with a locking angle to adjustably fix the locking angle to the panel.

DETAILED DESCRIPTION OF THE INVENTION

Figure 1:
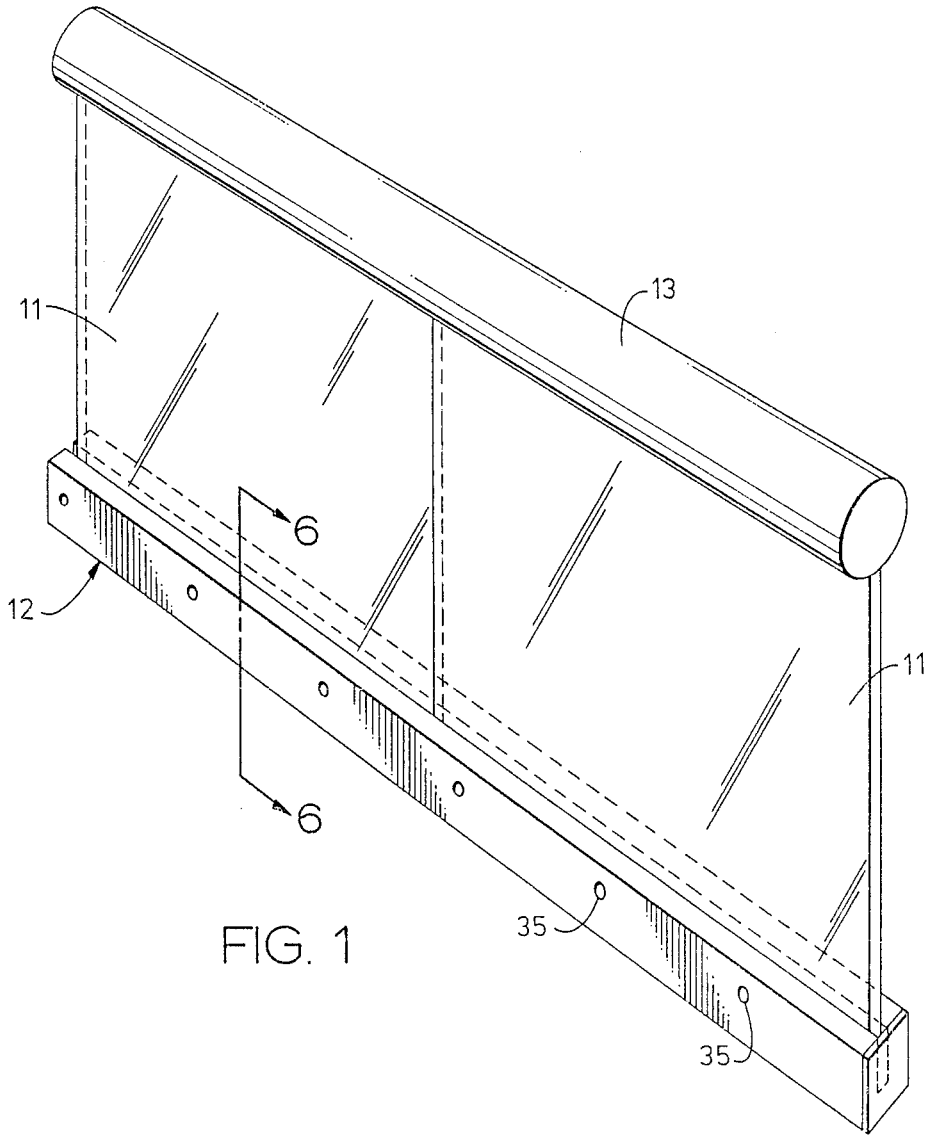
FIG. 1 is a view in perspective of the support base system of this invention with a series of architectural panels positioned therein.

Referring to the drawings, and FIG. 1 in particular, there is shown a set of architectural panels of the type which utilizes the invention. A walkway railing is comprised of glass panels 11. A support base system shown generally as 12 is permanently secured to the floor using conventional fastening means. Preferably, the fastening means are hidden from view for aesthetic reasons. Top cap 13 is positioned on the top edge of the glass panels for decorative and safety reasons.

Figure 2:
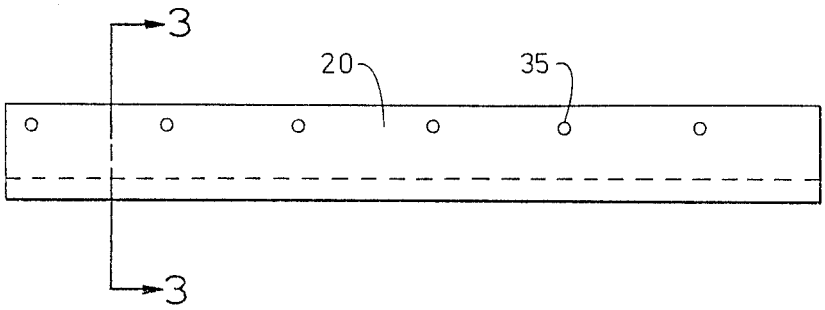
FIG. 2 is a side view of the support base system shown in FIG. 1.
Figure 3:
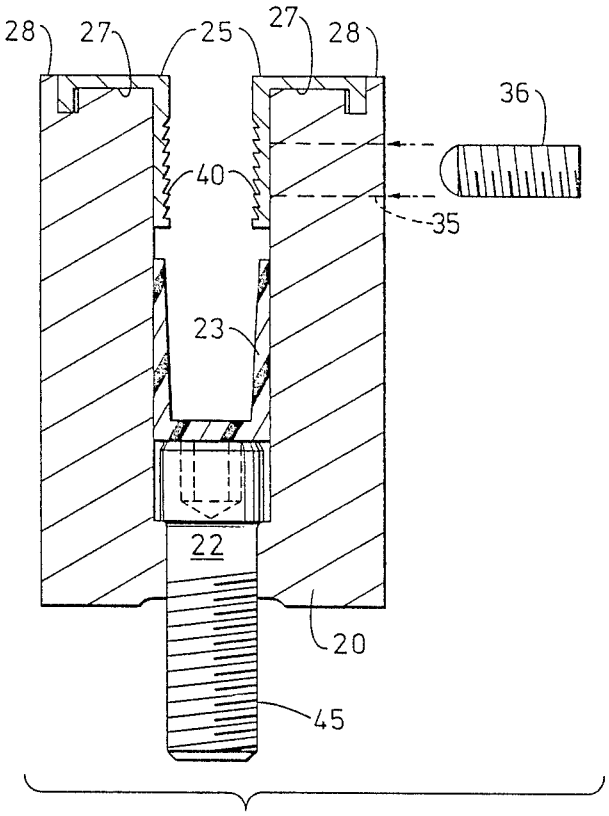
FIG. 3 is a sectional view of the support base system taken along line 3—3 of FIG. 2.

With reference to FIGS. 2 and 3 the support base system utilizes an elongated U-shaped support base 20 with a channel 21 extending from a top surface of the support base. The length of the support base is dependent only on the particular end use envisioned for the structure. Support bases with a length ranging from about two feet to about eighteen feet are sufficient for typical installations. Obviously, a series of individual support bases can be installed end to end for extended structures. The bases are made of an extruded metal. Aluminum is highly preferred because of its inherent strength and cost advantage. Composites of materials can as well be used, including various claddings adhered to the core material for appearance purposes.

Channel 21 extending from the top surface of the support base 20 and running preferably the entire length of the support base provides a receptacle for the glass panels 11. The channel is wide enough to slidably receive the panels. The depth of the channel is only sufficiently deep to steady the glass panels and is dependent to a certain extent on the weight and height of the panels. Bolt holes 22 are drilled vertically through the support base to provide a means of fastening the support base to the floor. Preferably, the holes are drilled through the channel's bottom surface for apparent manufacturing reasons.

A U-shaped insert 23 is positioned in a bottom portion of the channel 21. The outside width of the insert is such that the insert fits in the channel without any substantial lateral movement. The inside width of the insert is designed to receive the glass panel without substantial lateral movement of the panel itself. Thus, by properly dimensioning the channel and the U-shaped insert taking into consideration the particular glass panel ensures that the bottom of the glass panel is held in a steady position with substantially no lateral movement possible. The glass panel rests upon the base of U-shaped insert or, as further discussed below, the glass panel can be held in a spaced relationship from the base of the insert to accommodate uneven floor surfaces or specific design choices.

Figure 4:
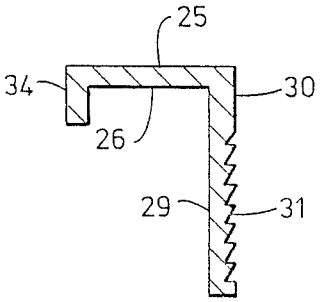
FIG. 4 is an end view of a locking angle used in the support base system of FIG. 1.
Figure 5:
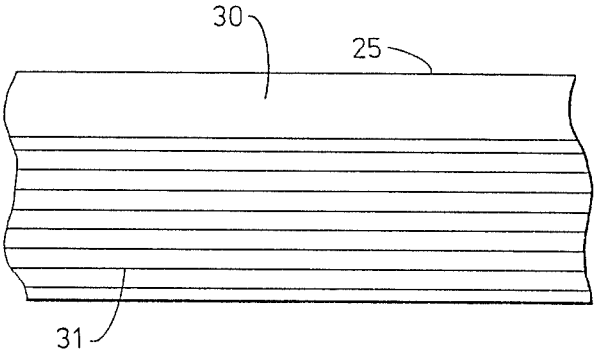
FIG. 5 is a side view of the locking angle of FIG. 1.

Locking angles 25 are positioned on the top surface of the support base on each side of the channel. The locking angles extend substantially the entire length of the channel. A first leg 26 lies substantially flat with the top surface of the support base. Preferably, a recess 27 is provided in the support base so that the top exposed portions 28 of the support base and the top of the locking angles 25 form a flat surface for appearance purposes. A second leg 29 of each locking angle extends into the channel. As evident in FIGS. 4 and 5 the face 30 of the second leg is provided with a series of horizontal ribs 31. The ribs 31 provide a gripping surface for better holding the glass panel.

The dimensions of the locking angle are dependent on the support base's width and channel's depth and width. Obviously, the first leg 26 of the locking angle does not extend past the side edges of the support base for appearance and safety reasons. The second leg 29 extends only partially into the channel, stopping short of the U-shaped insert. Preferably, a flange 34 extends at a right angle from the end of each leg 26 a short distance. Appropriately positioned grooves in the support base are provided to receive the flanges. The purpose of each flange is to properly position the locking angles during installation and use.

At least one side of the support base is provided with a series of set screw holes 35 and set screws 36 therein. The set screws extend through the screw holes 35 to abut against a back side of the locking angle. Preferably, the set screw holes are provided on each side of the support base to achieve maximum installation flexibility. Tightening the individual set screws causes the locking angle to engage the glass panel in whatever height position is desired. Preferably, a set screw hole is provided each about one to about two lineal feet of the elongated support base. Generally, heavy panels such as architectural glass will require closer spaced set screws in the support base to securely hold it than lighter panels such as wood panels.

A highly preferred embodiment of the invention utilizes a thin layer of polymeric material placed on the locking angle ribs. It has been found that increased gripping power results from use of the polymeric material. The polymeric material is typically in the form of a strip of film, spray-applied coating or hand applied coating. Examples of such material are films and coatings commercially available as Tremco Spectrum 2 Silicone Construction Sealant and GE RTV Silicone Sealant.

Figure 6:
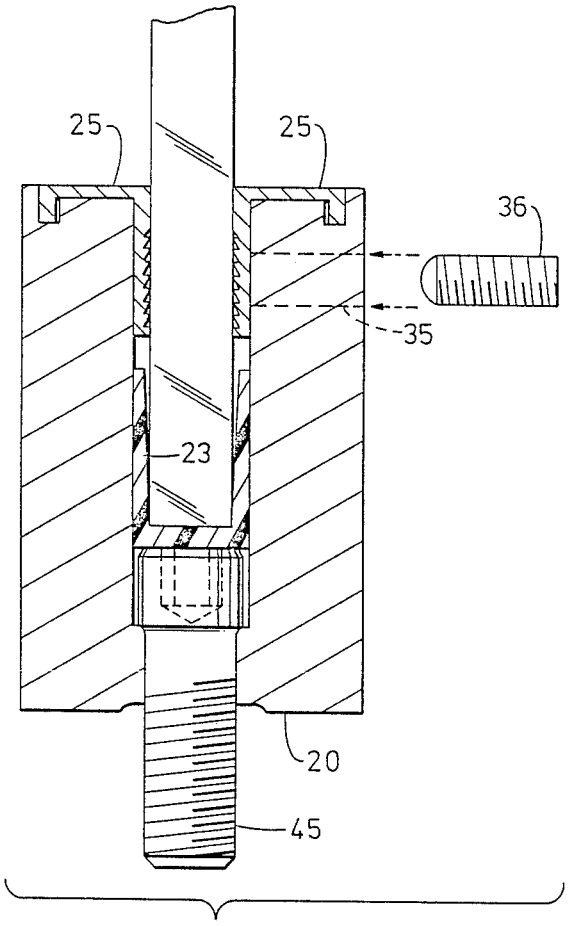
FIG. 6 is a sectional view taken along line 6—6 of FIG. 1 showing the support base system with the glass panel positioned in it.
Figure 7:
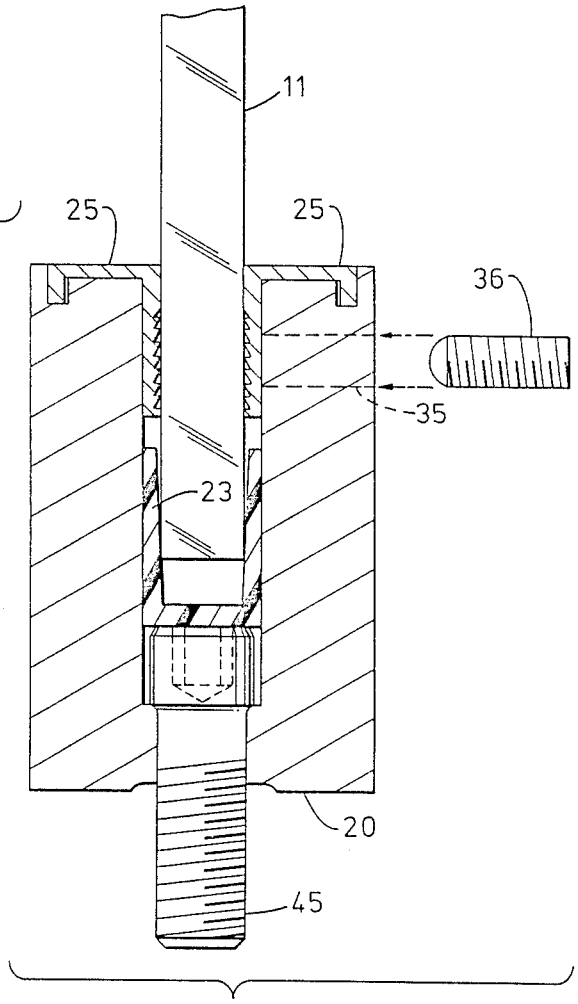
FIG. 7 is an end sectional view of the support base system showing the positioning of a panel within the support base to accommodate a particular panel height need.

FIGS. 6 and 7 show the advantages of the invention which are most evident during installation of the glass panels. Initially, the elongated support base is cut to length and bolted or otherwise secured permanently to the floor. A bolt 45 extends through bolt hole 22 and is anchored in the floor. Next, the U-shaped insert 23 is positioned in the bottom of the channel 21. The set screws 36 along the length of the support base are retracted so that the locking angles 25 are free to move or are even initially remote from the channel. Each glass panel is slid into the support bases's channel and received by the U-shaped insert. The glass panel can be allowed to rest entirely on the insert as shown in FIG. 6. However, the height of the glass panel in the channel can as well be readily adjusted to accommodate an uneven floor surface or design choice as shown in FIG. 7. Once a desired height is attained, the glass panel is steadied while the individual set screws are tightened until at least one of the locking angles is pressed against the panel sufficient enough to securely hold the panel. When this is accomplished, the glass panel is securely held in a permanent position.

Subsequent panels, if any, in the same support base are abutted against an installed panel and secured in a like manner. It should be quite evident the actual installation of the individual panels in the support base is not labor intensive. In fact, the installation is readily accomplished without any time needed for clean up of excess grout, etc.

The elongated support base of this invention can be fabricated to accommodate several architectural design needs. Thus, straight dividers of indefinite length, walkway guards which follow an inclined floor surface and right angled enclosures are possible; it being only necessary to fabricate the support base to fit a given structural design and floor surface.

Other modifications of the described invention are possible. All obvious variations are intended to be within the scope of the appended claims.

What is claimed is:

1. A support base system for securely holding one or more architectural panels in adjustable height positions to accommodate uneven floor surfaces and architectural design needs, comprising:

(a) an elongated U-shaped support base with a channel extending from a top surface and having a sufficient width to slidably receive a panel;

(b) a U-shaped insert positioned in a bottom portion of the channel, said insert having an inside cross dimension of sufficient width to receive and hold the panel in a laterally substantially immovable position;

(c) a pair of locking angles positioned along a top surface of the support base, each of said locking angles extending substantially the length of the support base with a first leg lying substantially flat with the top surface of the support base and a second leg extending into the channel, further wherein a face of said second leg has a series of gripping ribs to engage a face of the panel; and (d) a series of set screw holes along at least one side of the support base with set screws therein for communication with the locking angle to adjustably secure the locking angle to the panel such that the panel can be adjustably positioned in the channel prior to individually tightening the set screws.

2. The support base system of claim 1 further comprising a thin layer of polymeric material positioned on the locking angle's ribs so as to better hold the panel in position.

3. The support base system of claim 2 wherein the polymeric material is a silicone coating material.

4. The support base system of claim 1 wherein the top surface of the support base is provided with a recessed portion to receive said locking angles such that a substantially flat surface is formed by the locking angles and support bases's top surface.

5. The support base system of claim 1 wherein the set screw holes extend along both sides of the support base.

6. The support base system of claim 5 wherein a set screw hole is provided each about one to about two lineal feet of the support base.

7. The support base system of claim 6 further wherein attachment means are provided for securing the support base to a floor.

8. The support base system of claim 7 wherein the attachment means comprises a series of bolt holes drilled vertically through a bottom surface of the channel with bolts extending therethrough.

* * * * *